US006142894A

United States Patent [19]

Lee

[11] Patent Number: 6,142,894

[45] Date of Patent: Nov. 7, 2000

[54] ARTICLE PRODUCING SOUND AND LIGHT ON IMPACT

[76] Inventor: Yu-Shien Lee, No. 14, Lane 12, Min Hsiang Street, Hsin Chu, Taiwan

[21] Appl. No.: 09/252,970

[22] Filed: Feb. 19, 1999

[51] Int. Cl.[7] ..... A63B 43/06; F42B 4/16

[52] U.S. Cl. ..... 473/570; 473/571; 446/397; 446/473

[58] Field of Search ..... 473/570, 571, 473/569; 446/397, 473, 485, 494

[56] References Cited

U.S. PATENT DOCUMENTS

| | | | |
|---|---|---|---|
| 3,102,727 | 9/1963 | Rice | 473/570 |
| 3,458,205 | 7/1969 | Smith et al. | 473/570 |
| 3,740,543 | 6/1973 | Franc | 446/485 |
| 4,662,260 | 5/1987 | Rumsey | 473/571 |
| 5,186,458 | 2/1993 | Redondo | 473/570 |
| 5,246,372 | 9/1993 | Campagnuolo et al. | 446/473 |
| 5,316,293 | 5/1994 | Hamilton | 473/570 |
| 5,388,825 | 2/1995 | Myers et al. | 473/570 |
| 5,816,885 | 10/1998 | Goldman et al. | 446/397 |

*Primary Examiner*—Steven Wong
*Attorney, Agent, or Firm*—Dougherty & Troxell

[57] ABSTRACT

An article suitable for throwing in games and able to produce sound and light on impact is provided. The article includes a rigid inner shell having sound and light producing apparatus mounted therein and a flexible outer layer integrally formed from clear or opaque plastic material to cover the entire inner shell and to provide the article with sufficient impact strength and safety in use. The sound and light producing apparatus is powered with batteries and preset to be actuated on impact. The inner shell and the outer layer are formed of aligned sound holes and insertion slots. When the article is not in use, an insert plate can be inserted into the aligned insertion slots to open the circuit of the sound and light producing means and thereby prevents the same from unexpected actuation and unnecessary consumption of battery energy.

2 Claims, 3 Drawing Sheets

ARTICLE PRODUCING SOUND AND LIGHT ON IMPACT

BACKGROUND OF THE INVENTION

The present invention relates to an article producing sound and light on impact, and more particularly to an article having an integrally formed flexible outer layer to provide sufficient impact strength and safety in use, and an inner shell having sound and light producing means mounted therein to produce sound and light when the article is thrown and collides with something. When the article is not in use, an insert plate may be inserted into the inner shell to locate between two batteries to break the circuit thereof, so that unnecessary waste of battery energy can be avoided.

There are many differently designed sound and light producing toys or articles for use in games. Some of these toys and articles are particularly designed to be suitable for throwing, such as a sound-and-light-producing shuttlecock that produces sound and light when flying or being hit. Basically, all such sound and light producing toys and articles have a differently shaped outer layer to define an inner space for accommodating sound and light producing means therein. It is necessary to take following factors into consideration when designing such sound and light producing toys and articles:

1. The sound and light producing means must be properly enclosed in the outer layer to avoid being easily damaged when the toys and articles are used in games.
2. When the toys and articles are intended for throwing in games, the outer layer must have sufficient impact strength while providing safety in use, lest the toys or articles should cause dangers when they are thrown at any player in the games.
3. Since the sound and light producing means is powered by non-replaceable batteries enclosed in the outer layer, it is desired to have ways to avoid unnecessary waste of battery energy due to unexpected switch-on of the sound and light producing means during, for example, transportation and sale of the toys and articles.
4. To reduce the manufacturing cost of the toys and articles, they are preferably so designed to allow mass production.

SUMMARY OF THE INVENTION

It is therefore a primary object of the present invention to provide an article that is suitable for throwing in games and can produce sound and light on impact. The article includes an inner shell having sound and light producing means mounted therein and a flexible outer layer integrally formed over the entire inner shell to provide the article with sufficient impact strength and safety in use.

Another object of the present invention is to provide an article producing sound and light on impact that has an integrally formed outer layer with an outer insertion slot corresponding to and aligned with an insertion slot formed on an inner shell, so that an insert plate may be inserted into the inner shell via the insertion slots to break a circuit of a sound and light producing means in the inner shell, whereby no battery energy would be consumed when the insert plate is inserted in the article that is not in use.

DETAILED DESCRIPTION OF THE PREFERRED EMBODIMENTS

Figure 2:
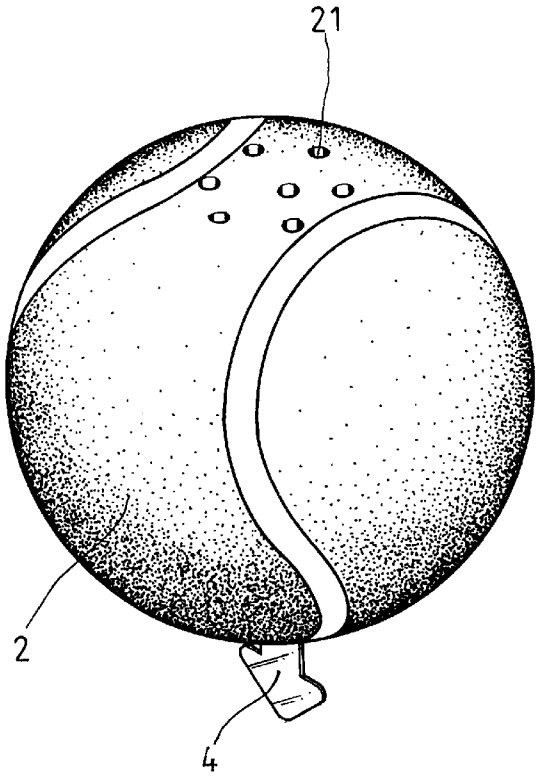
FIG. 2 is a complete perspective of the ball of FIG. 1.
Figure 1:
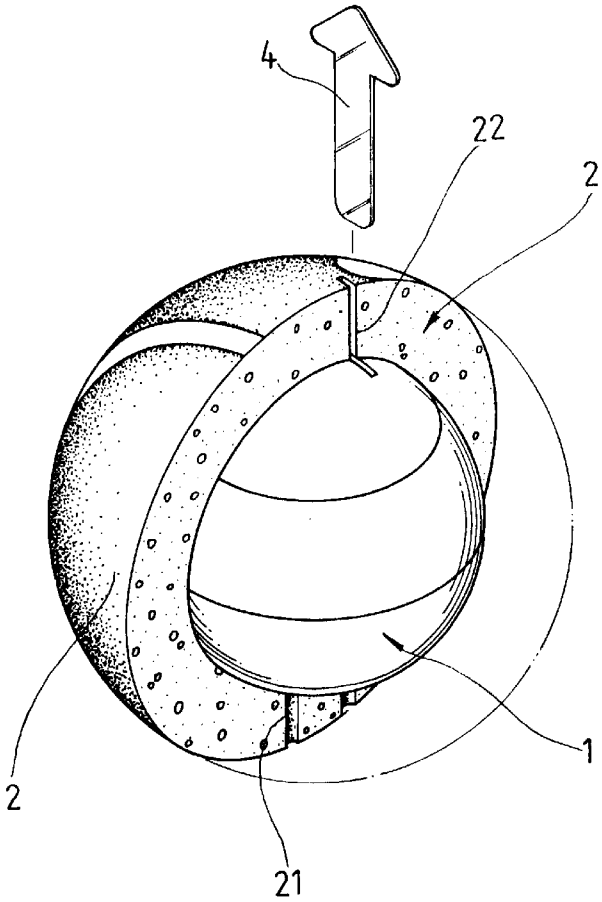
FIG. 1 a perspective of a ball according to the present invention with a part of its outer layer removed to better show an internal structure thereof.
Figure 3:
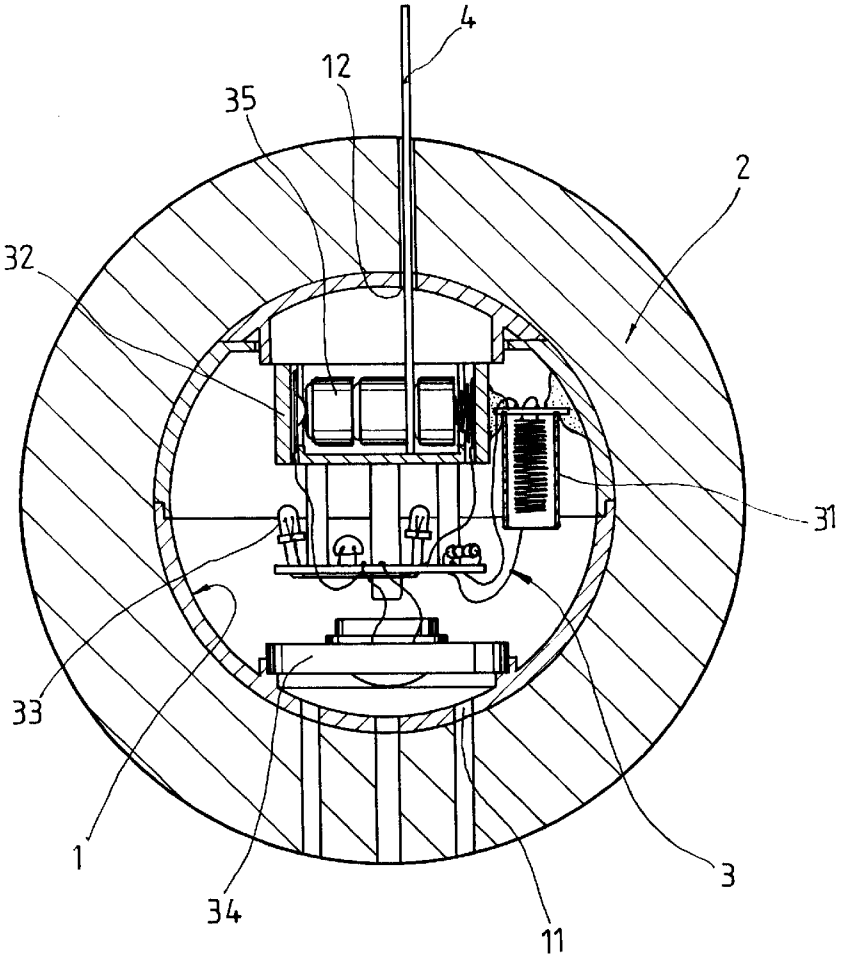
FIG. 3 is a cross sectional view of the ball of FIG. 1.

Please refer to FIGS. 1, 2 and 3 in which a ball according to an embodiment of the present invention is shown. As shown, the ball mainly includes an inner shell 1 and an outer layer 2. A set of sound and light producing means 3 is provided inside the inner shell 1. The sound and light producing means 3 may be designed with known skills in the relevant technical field to show different effects. The means 3 shown in FIG. 3 is only an embodiment thereof and mainly includes an impact switch 31, a battery compartment 32, a light source 33, and a speaker 34. It is, of course, also possible to let the means 3 be only a sound producing means or a light producing means simply depending on the actual need, so long as the means 3 could be firmly mounted inside the inner shell 1. Meanwhile, the sound and light producing means 3 has batteries and a switch that is preset by the manufacturer in the process of production to be actuated in predetermined manners. In other words, the means 3 can be actuated to sound and emit light in a manner already set by the manufacturer in manufacturing process. There are batteries already mounted in the battery compartment 32 to supply sufficient power to the impact switch 31. And, to facilitate the design and manufacture of the ball of FIG. 1, it is preferable to have the battery compartment 32 and the speaker 34 located at diametrically opposite positions in the inner shell 1, as shown in FIG. 3, with the speaker 34 facing downward to align with sound holes 11 provided on the inner shell 1 and the battery compartment 32 facing upward to accommodate serially connected batteries 35. The inner shell 1 is provided with an insertion slot 12 that extends in a direction across the serially connected batteries 35 and is at a position over the battery compartment 32, such that when a thin insert plate 4 is inserted into the inner shell 1 via the insertion slot 12, the insert plate 4 will just locate between two adjacent batteries 35 in the battery compartment 32 to easily break a close circuit of the sound and light producing means 3.

Figure 4:
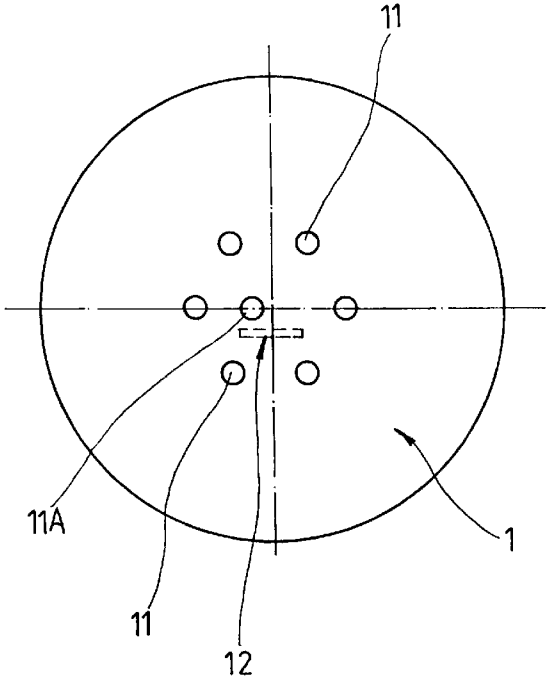
FIG. 4 is a plan view showing the arrangement of sound holes and insertion slot on an inner shell of the ball of FIG. 1.

The outer layer 2 is integrally formed over an entire outer surface of the inner shell 1 by positioning the completely assembled inner shell 1 in a mold (not shown) into which material for forming the outer layer 2 is then injected to closely cover the entire inner shell 1. The outer layer 2 may be integrally formed from clear flexible plastic material, such as PU, or opaque foaming plastic material. The outer layer 2 is preferably formed to have an adequate thickness and flexibility to provide sufficiently impact strength and safety in use to avoid accident when the ball hits a player. The integrally formed outer layer 2 is provided with multiple outer sound holes 21 and an outer insertion slot 22 corresponding to and aligned with the sound holes 11 and the insertion slot 12, respectively, formed on the inner shell 1, so that sound produced by the means 3 may be effectively transmitted outward via the aligned sound holes 11 and 21 and the insert plate 4 may be fully inserted to locate between two batteries 35 via the aligned slots 12 and 22. FIG. 4 illustrates a feasible way to align the sound holes 11 and the insertion slot 12 with the outer sound holes 21 and the outer insertion slot 22, respectively. As shown, there is an eccentric sound hole 11A particularly formed among the sound holes 11 that are radially symmetrically arranged on the inner shell 1, and the mold for forming the outer layer 2 is provided with holes corresponding to the holes 11 and 11A. By always positioning the assembled inner shell 1 in the mold with the sound holes 11 and the eccentric sound hole 11A aligned with the holes and the eccentric hole formed on the mold, the outer layer 2 can be always formed with the outer sound holes 21 aligned with the sound holes 11 and 11A, and accordingly, the outer insertion slot 22 aligned with the insertion slot 12. Therefore, in the case the inner shell 1 of the article made according to the present invention is in a spherical form, and, in order to facilitate easy integral forming and knock-out of the outer layer 2 in and from the mold, it is preferable to have the insertion slot 12 and the sound holes 11 located at diametrically opposite positions on the inner shell 1 and to directly form an eccentric sound hole 11A on the inner shell 1 to serve as a reference of locating the inner shell 1 in the mold for forming the outer layer 2.

Figure 6:
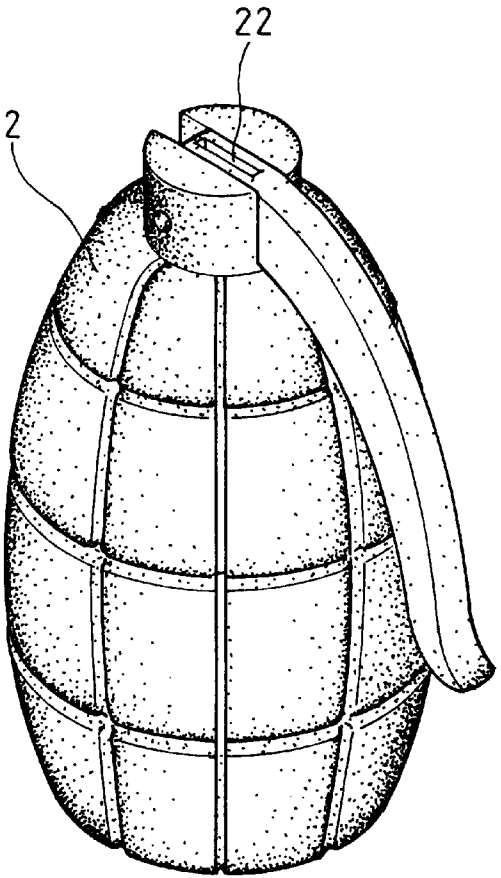
FIG. 6 is a toy grenade made according to the present invention.
Figure 5:
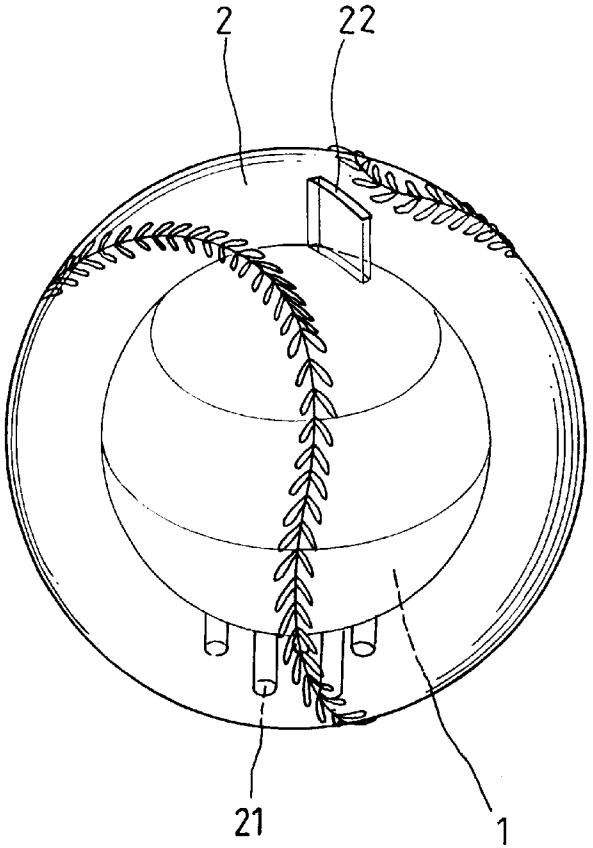
FIG. 5 is another ball made according to the present invention.

FIGS. 5 and 6 illustrate examples of differently shaped outer layer 2 for articles made according to the present invention. FIG. 5 shows a baseball and FIG. 6 shows a toy grenade.

When an article made according to the present invention is thrown in games, the sound and light producing means 3 thereof would be actuated by the preset switch in the means 3 to produce sound and light in different manners. When the article is not in use, the insert plate 4 maybe inserted into the article via the outer insert slot 22 and the insert slot 12 to locate between two batteries 35 inside the inner shell 1 and thereby breaks the circuit provided by the batteries 35. This avoids the energy of the batteries 35 from unnecessary waste when the article is not in use. For articles of the present invention that are powered with non-replaceable batteries sealed in the inner shell 1, the insert plate 4 is an effective energy-saving means to prolong the life of the articles for producing sound and light during games.

What is claimed is:

1. An article producing sound and light on impact, comprising an inner shell and an outer layer;

said inner shell being made of hard material to define an inner space for accommodating a sound and light producing means including a separate thin plate therein, said sound and light producing means including batteries and a switch preset to be actuated on impact, and said inner shell being provided at predetermined positions with multiple sound holes and an insertion slot that allows said separate thin plate to be inserted between two of said batteries included in the sound and light producing means to break a circuit thereof; and said outer layer being integrally formed from plastic material through molding, and said outer layer being directly formed over an entire outer surface of said inner shell and having multiple outer sound holes and an outer insertion slot corresponding to and aligning with said sound holes and said insertion slot on said inner shell;

whereby when said article is used and thrown in games, said outer layer provides sufficient impact strength to protect said inner shell from damage due to impact and sufficient flexibility to ensure safety in use; and when said article is not in use, the circuit of said sound and light producing means can be opened to prevent unexpected actuation of said switch and undesired power consumption by inserting said separate thin plate into said insertion slots on said outer layer and said inner shell.

2. An article producing sound and light on impact as claimed in claim 1, wherein said insertion slot and said sound holes on said inner shell are formed at diametrically opposite positions on said inner shell, and one of said sound holes being eccentrically formed relative to other sound holes to serve as a reference for locating said inner shell in said mold to ensure alignment of said outer insertion slot with said insertion slot when forming the outer layer.

* * * * *